US009472321B2

(12) United States Patent
Stangl

(10) Patent No.: US 9,472,321 B2
(45) Date of Patent: Oct. 18, 2016

(54) CABLE COMPRISING INDICATOR MATERIAL FOR DETECTING DAMAGE CONTROL

(75) Inventor: Gunther Stangl, Kirchseeon (DE)

(73) Assignee: Pruftech GmbH, Haar (DE)

( * ) Notice: Subject to any disclaimer, the term of this patent is extended or adjusted under 35 U.S.C. 154(b) by 243 days.

(21) Appl. No.: 13/514,686

(22) PCT Filed: Dec. 9, 2010

(86) PCT No.: PCT/EP2010/069260

§ 371 (c)(1),
(2), (4) Date: Aug. 17, 2012

(87) PCT Pub. No.: WO2011/070106

PCT Pub. Date: Jun. 16, 2011

(65) Prior Publication Data

US 2012/0298398 A1 Nov. 29, 2012

(30) Foreign Application Priority Data

Dec. 9, 2009 (DE) ..... 10 2009 047 745

(51) Int. Cl.
*H01B 7/32* (2006.01)
*H01B 7/18* (2006.01)

(52) U.S. Cl.
CPC ..... *H01B 7/32* (2013.01); *H01B 7/1875* (2013.01)

(58) Field of Classification Search
CPC ..... H01B 7/32
USPC ..... 174/110 R, 110, 120
See application file for complete search history.

(56) References Cited

U.S. PATENT DOCUMENTS

| | | | | | |
|---|---|---|---|---|---|
| 5,922,996 | A * | 7/1999 | Ryeczek | G01K 11/12 116/207 |
| 6,119,922 | A * | 9/2000 | Hall, Jr. | B03C 1/12 156/47 |
| 2002/0170739 | A1* | 11/2002 | Ryeczek | 174/112 |
| 2005/0034892 | A1 | 2/2005 | Philips et al. | |

FOREIGN PATENT DOCUMENTS

| | | | | |
|---|---|---|---|---|
| DE | 519557 | C | 3/1931 | |
| DE | 1100345 | B | 2/1961 | |
| DE | 10047905 | | 5/2002 | |
| FR | 2704973 | A1 | 11/1994 | |
| JP | 07282644 | | 10/1995 | |
| JP | 11023923 | * | 1/1999 | |
| JP | 11023923 | A * | 1/1999 | G02B 6/44 |
| JP | 2003197044 | | 7/2003 | |

* cited by examiner

*Primary Examiner* — Timothy Thompson
*Assistant Examiner* — Charles Pizzuto
(74) *Attorney, Agent, or Firm* — MH2 Technology Law Group, LLP

(57) ABSTRACT

The invention relates to a cable with a sheath and an indication material that in case of damaging of the sheath at least partially escapes from the cable.

5 Claims, 3 Drawing Sheets

CABLE COMPRISING INDICATOR MATERIAL FOR DETECTING DAMAGE CONTROL

TECHNICAL FIELD

The invention relates to a cable or a tube with an integrated indication material that allows detecting damaging of the cables easily.

BACKGROUND ART

Before the use of many cables, particularly connection cables of electrical devices, it has to be ensured that these devices are not damaged, because otherwise safety problems as for example the endangering of a person or the arising of fires may occur.

Particularly, if a cable is clamped or bent, damages may occur that are not necessarily easy to detect. In order to protect the inside conductors, the cables are usually covered by a sheath. Therefore, in case of damaging of the cable mostly the sheath gets damaged first.

The problem underlying the present invention is to provide a cable, wherein damaging of the sheath in particular is easy to detect also for the layperson.

This problem is solved by a cable according to the independent claim. Preferred embodiments of a cable according to the invention are described in the dependent claims.

SUMMARY OF INVENTION

A cable according to the present invention has a sheath. This can be, for example, an insulating sheath around a single conductor or also a sheath comprising several conductors, wherein each conductor has its own insulation. A cable according to the invention further has an indication material that in case of damaging of the sheath at least partially escapes from the cable.

Preferably the indication material is arranged in the cable so that it does not get into contact with ambient air. In this case the indicating material may be formed so that it escapes from the cable, if it gets into contact with the ambient air and reacts with the oxygen contained therein. For example in the case of contact with oxygen, the indication material can swell and, thus, escape from the cable.

In a preferred embodiment the indicating material comprises a colored substance, preferably in a signal color clearly differing from the color of the cable or its sheath. Thus, it can be detected easily when the indication material escapes from the cable in the case of damaging thereof.

In a further preferred embodiment the indication material comprises an odorant that in the case of damaging of the cable escapes thereof and, thus, can be perceived.

Also several indication materials can be provided. For example, one that becomes visible in the case of damaging of the cable and one that can be smelled. A single indication material can just as well comprise both a signal color and an odorant.

The indication material can be arranged outside of the sheath, i.e. surrounding the sheath, or also within the sheath, i.e. so that the sheath surrounds the indication material. Further, the indication material can be mixed with or connected to the sheath.

If the indication material is arranged outside of the sheath and reacts with oxygen, in a preferred embodiment there is a protective layer provided outside of the indication material, which prevents the indication material from getting into contact with oxygen as long as the cable is not damaged.

It can also be provided to arrange a protective layer within the indication material, if the indication material is arranged within the sheath. This can be advantageous, especially if it cannot be excluded during the production of the cable that also the inside of the cable gets into contact with air oxygen.

A further advantage of the present invention is that the use of the cables according to the invention leads to a better risk assessment of the workplace or the used work equipment. This can be accompanied by an extension of the statutory inspection intervals for this workplace or this work equipment, whereby standstill can be avoided and costs can be reduced.

BRIEF DESCRIPTION OF THE DRAWINGS

By means of the drawings the invention hereinafter is explained in detail. It is shown by.

DETAILED DESCRIPTION OF THE EMBODIMENTS

Figure 1:
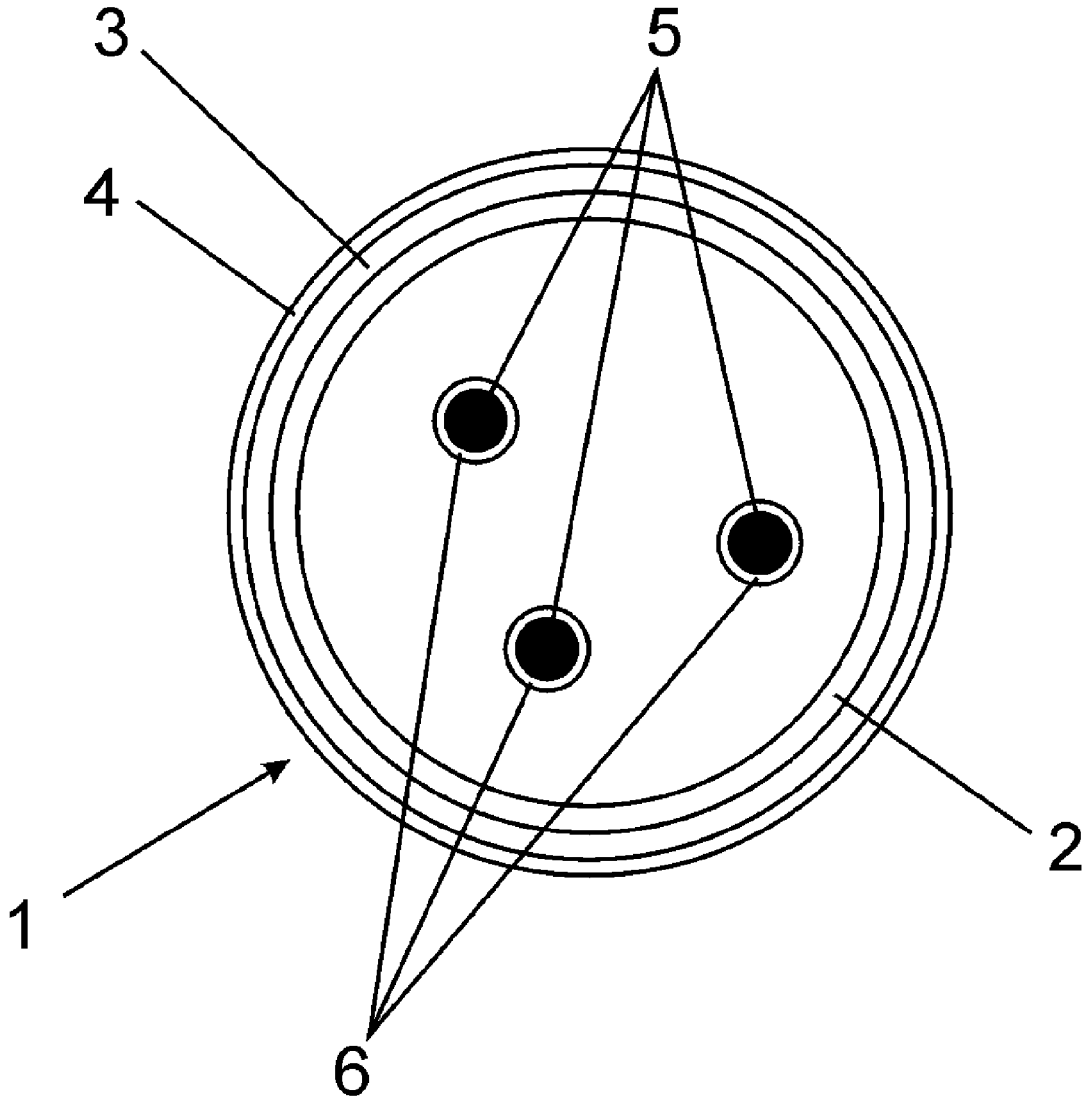
FIG. 1 a schematic presentation of a cross-section through a first

From the presentation according to FIG. 1 the set-up of a first embodiment of a cable according to the invention becomes apparent. The cable (1) is a connection cable with three conductors (5) inside, each of which is surrounded by an insulation (6) in order to insulate them electrically from each other.

The three conductors (5) are surrounded by a sheath (2)that holds them together and protects them from mechanical loads. Outside of the sheath (2) a layer of indication material (3) is arranged, which again is surrounded by a protective layer (4). The protective layer (4) can be held in a neutral color (white, grey, black).

The indication material (3) is protected from contact with the oxygen of the ambient air by protective layer (4). If the cable (1) gets damaged due to external influences, e.g. due to clamping or bending or in some other way, such damaging effects the protective layer (4) first.

If the load increases in a way that the protective layer (4) gets damaged in one or several positions, e.g. tearing off, the indication material (3) gets into contact with the air oxygen at that position. This leads to a reaction of the indication material (3) with the air oxygen, whereby the indication material (3) swells and escapes from the cable (1) at the damaged position of the protective layer (4).

The indication material (3) is held in a color that clearly differs from the color of the protective layer (4) and that can be well perceived (e.g. red, orange, and yellow). Thus, it can be determined by a simple inspection test (before installation of the cable or even during a routine inspection), if a damaging of the cable (1) exists.

In the embodiment shown in FIG. 1 it is ensured by the arrangement of the indication material outside of the sheath (2) that in case of external influences the protective layer (4) gets damaged first, so that in any case it can be detected, if it comes to a damaging of the sheath (2), which is located within the protective layer (4) and the indication material (3). However, indication material (3) escaping from the cable (1) does not necessarily mean that also the sheath (2), which is located further inside, got damaged.

Figure 2:
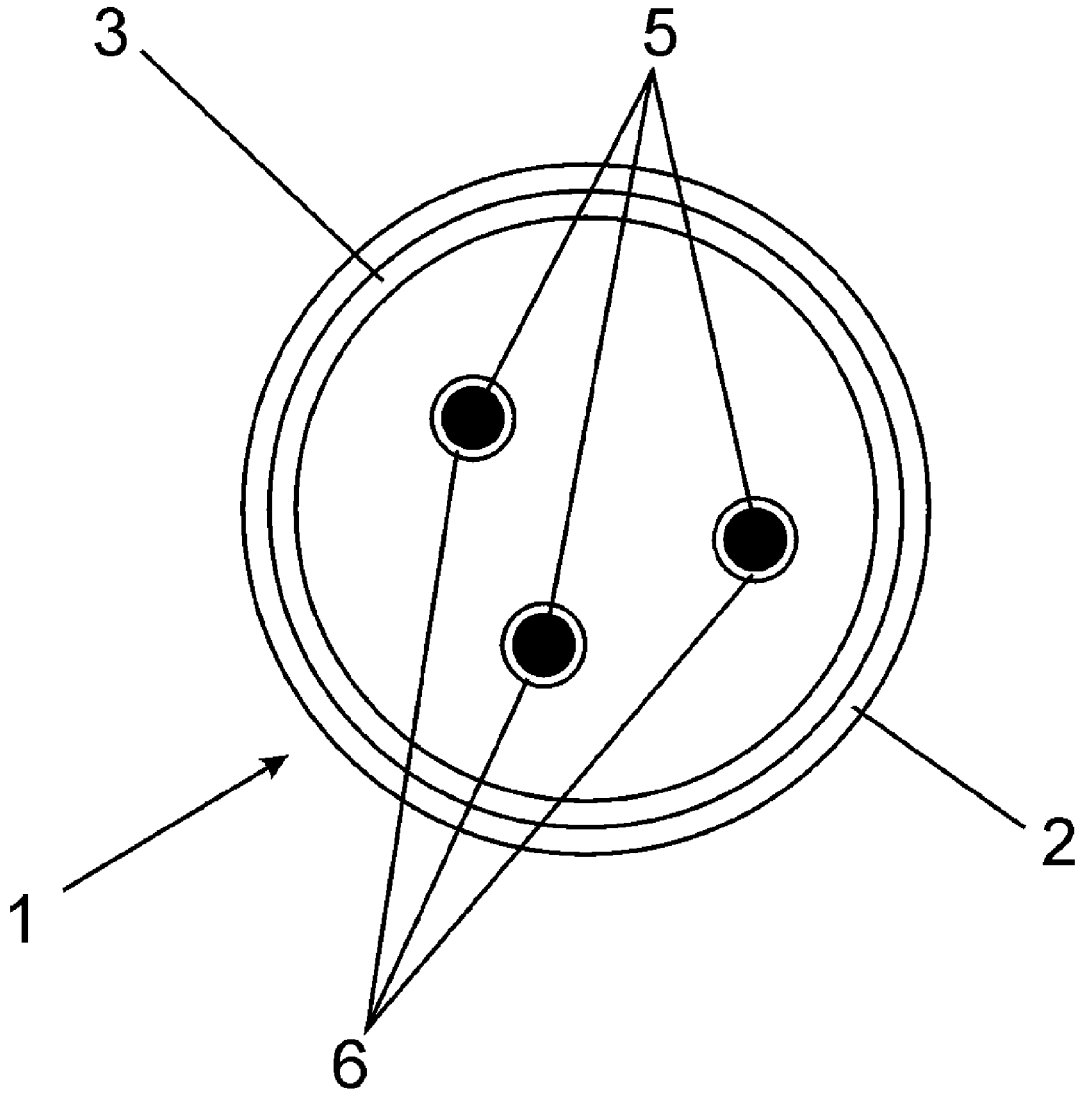
FIG. 2 a schematic presentation of a cross-section through a second embodiment of a cable according to the invention, and FIG. 3 a schematic presentation of a cross-section through a third embodiment of a cable according to the invention.

The embodiment of a cable (1) according to the invention shown in FIG. 2 differs from the embodiment according to FIG. 1 in that the indication material (3) is located within the sheath (2). For this reason in the second embodiment there is no protective layer necessary, protecting the indication material (3) from contact with the oxygen of the ambient air.

In the embodiment according to FIG. 2 the sheath (2) can be held in a neutral color (white, grey, black), while the indication material (3) is held in a color that clearly differs from the color of the sheath (2) and can be well perceived (e.g. red, orange, yellow).

Due to this arrangement of the sheath (2) and the indication material (3), the indication material (3) only escapes from the cable (1), if the sheath (2) is damaged so strongly that the layer of indication material (3) lying underneath gets into contact with air oxygen.

Figure 3:
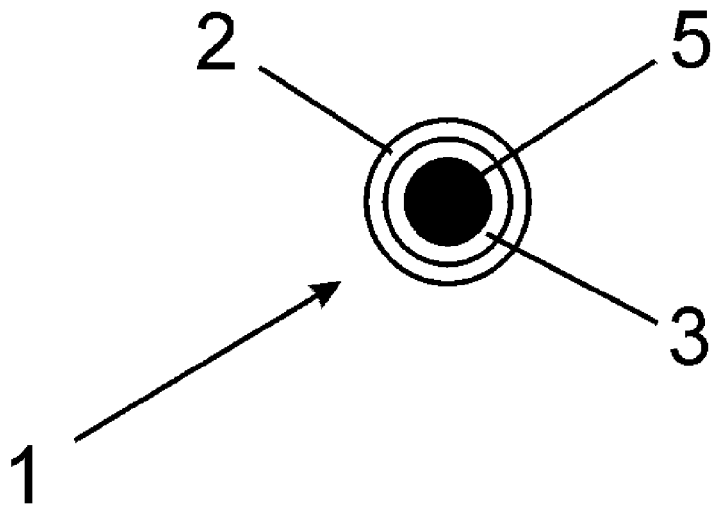

The third embodiment of a cable (1) according to the invention shown in FIG. 3 has only one electric conductor (5) inside of the cable (1). This conductor (5) is directly surrounded by a layer of indication material (3), which again is surrounded by the sheath (2). The color of the indication material (3) and the sheath (2) is chosen in a way that it can be easily detected, if indication material (3) reacts with the air oxygen and escapes from the cable (1) due to damaging of the sheath (2).

The invention is not limited to the embodiments shown in the figures. A tube may be understood as a cable according to the invention which has no inner electrical conductors but only a coat and an indication material as described above. Such a tube can be used as pneumatic line or pressurized oil pipeline, for example. Moreover, the invention is not limited to electrical cables but can also be used for light-conducting cables, for example.

REFERENCE SIGNS

1 cable
2 sheath
3 indication material
4 protective layer
5 conductor
6 insulation

The invention claimed is:

1. A cable with a sheath, comprising an indication material that in case of damaging of the sheath at least partially escapes from the cable, wherein the indication material is part of the sheath.

2. The cable according to claim 1, wherein the indication material escapes from the cable in case of contact with oxygen.

3. The cable according to claim 1, further comprising a protective layer outside the indication material.

4. The cable according to claim 1, wherein the indication material comprises a colored substance, preferably with a signal color.

5. The cable according to claim 1, wherein the indication material comprises an odorant.

* * * * *